US010330350B2

(12) United States Patent
Zhao et al.

(10) Patent No.: US 10,330,350 B2
(45) Date of Patent: Jun. 25, 2019

(54) AIR CONDITIONING SYSTEM, COMPRESSION SYSTEM WITH GAS SECONDARY INJECTION AND JUDGMENT AND CONTROL METHOD THEREOF

(71) Applicant: Gree Electric Appliances, Inc. of Zhuhai, Zhuhai (CN)

(72) Inventors: Huan Zhao, Zhuhai (CN); Feng Tan, Zhuhai (CN); Pengfei Li, Zhuhai (CN); Youxuan Liang, Zhuhai (CN)

(73) Assignee: Gree Electric Appliances, Inc. of Zhuhai, Guangdong (CN)

( * ) Notice: Subject to any disclaimer, the term of this patent is extended or adjusted under 35 U.S.C. 154(b) by 0 days.

(21) Appl. No.: 16/060,695

(22) PCT Filed: Sep. 12, 2016

(86) PCT No.: PCT/CN2016/098676

§ 371 (c)(1),
(2) Date: Jun. 8, 2018

(87) PCT Pub. No.: WO2017/096992

PCT Pub. Date: Jun. 15, 2017

(65) Prior Publication Data

US 2018/0363954 A1 Dec. 20, 2018

(30) Foreign Application Priority Data

Dec. 10, 2015 (CN) ..... 2015 1 0916651

(51) Int. Cl.
*F25B 1/10* (2006.01)
*F24F 11/89* (2018.01)
(Continued)

(52) U.S. Cl.
CPC ..... *F25B 1/10* (2013.01); *F24F 11/83* (2018.01); *F24F 11/89* (2018.01); *F25B 41/04* (2013.01);
(Continued)

(58) Field of Classification Search
CPC ..... F25B 1/10; F25B 41/04; F25B 2400/077; F25B 2400/23; F24F 11/83; F24F 11/89
See application file for complete search history.

(56) References Cited

U.S. PATENT DOCUMENTS

2009/0044564 A1* 2/2009 Okamoto ..... F25B 1/10 62/510
2010/0275624 A1 11/2010 Lee et al.
2012/0167601 A1 7/2012 Cogswell et al.
(Continued)

FOREIGN PATENT DOCUMENTS

CN 1800747 A 7/2006
CN 200996753 Y 12/2007
(Continued)

*Primary Examiner* — Marc E Norman
(74) *Attorney, Agent, or Firm* — The Webb Law Firm

(57) ABSTRACT

Provided herein is a compression system including a compressor, an intermediate air compensation pipeline, and an air compensation valve disposed on the intermediate air compensation pipeline. According to a flow direction of a refrigerant, a first pressure detection device and a first temperature detection device are disposed at the inlet end of the air compensation valve on the intermediate air compensation pipeline; a second temperature detection device is disposed at the outlet end of the air compensation valve. The system also includes a second pressure detection device and a third temperature detection device disposed on an exhaust pipeline of the compressor.

15 Claims, 1 Drawing Sheet

(51) Int. Cl.

| | |
|---|---|
| ***F24F 11/83*** | (2018.01) |
| ***F25B 41/04*** | (2006.01) |
| ***F25B 49/02*** | (2006.01) |

(52) U.S. Cl.

CPC ..... *F25B 49/02* (2013.01); *F25B 2400/077* (2013.01); *F25B 2400/23* (2013.01); *F25B 2500/02* (2013.01); *F25B 2500/19* (2013.01); *F25B 2500/31* (2013.01); *F25B 2600/2509* (2013.01); *F25B 2700/1931* (2013.01); *F25B 2700/21152* (2013.01)

(56) References Cited

U.S. PATENT DOCUMENTS

| | | | | |
|---|---|---|---|---|
| 2012/0192579 | A1 | 8/2012 | Huff et al. | |
| 2014/0208787 | A1* | 7/2014 | Furui | F25B 40/00 62/222 |

FOREIGN PATENT DOCUMENTS

| | | | |
|---|---|---|---|
| CN | 101476791 | A | 7/2009 |
| CN | 101535732 | A | 9/2009 |
| CN | 202813860 | U | 3/2013 |
| CN | 103411291 | A | 11/2013 |
| CN | 203274353 | U | 11/2013 |
| CN | 103629873 | A | 3/2014 |
| CN | 105065248 | A | 11/2015 |
| CN | 204830555 | U | 12/2015 |
| CN | 105371514 | A | 3/2016 |
| CN | 205191969 | U | 4/2016 |
| EP | 2924369 | A1 | 9/2015 |
| JP | 2006125793 | A | 5/2006 |
| JP | 2006177597 | A | 7/2006 |
| JP | 201416119 | A | 1/2014 |
| KR | 1020140123822 | A | 10/2014 |
| WO | 2008042358 | A1 | 4/2008 |

* cited by examiner

AIR CONDITIONING SYSTEM, COMPRESSION SYSTEM WITH GAS SECONDARY INJECTION AND JUDGMENT AND CONTROL METHOD THEREOF

CROSS-REFERENCE TO RELATED APPLICATIONS

This application is the United States national phase of International Application No. PCT/CN2016/098676 filed Sep. 12, 2016, and claims priority to Chinese Patent Application No. 201510916651.X filed Dec. 10, 2015, the disclosures of which are hereby incorporated in their entirety by reference.

TECHNICAL FIELD

This disclosure relates to the air conditioning technical field, and especially relates to an air conditioning system, a compression system with gas secondary injection, and judgment and control method thereof.

BACKGROUND

The lower the environment temperature is, the greater the demand for heating capacity of air conditioner is. However, at −20° C., an existing heat-pump with single-stage compression can only be started normally, but its heating capacity is severely attenuated, so the heating effect cannot be guaranteed, and the reliability of the air conditioner is also severely challenged.

A two-stage compression system with enthalpy-increase by gas secondary injection has larger heating capacity and higher energy efficiency than a heat-pump with single-stage compression at a low temperature. Compared to the single-stage compressor, the two-stage compression system can reduce a pressure ratio and temperature of discharged air, and can increase air suction efficiency and compression efficiency, thereby increasing the heating capacity and the heating efficiency.

A two-stage compression with enthalpy-increase by gas secondary injection, includes a high-pressure stage compression and a low-pressure stage compression, and has two or more cylinders in which the cylinder used for a first stage compressor is called as a low-pressure cylinder and the cylinder used for a second stage compressor is called as a high-pressure cylinder. The principle of enthalpy-increase by gas secondary injection is that a gaseous refrigerant which is injected into an air suctioned port of the high-pressure cylinder of the compressor from a port for increasing enthalpy by gas secondary injection positioned at the middle portion of the compressor is mixed up with a discharged refrigerant compressed by the low pressure cylinder, and then is compressed in the high pressure cylinder.

In a two-stage compression system with enthalpy-increase by gas secondary injection, the secondary injected gas has a very important influence on the system performance and reliability. The secondary injected gas mixed with a liquid will cause dilution of lubricant in the compressor. Due to the impact and incompressibility of the liquid, a lot of liquid refrigerant entering the compressor cylinder at a higher speed will cause air suction valve to break or bend excessively, and will cause severe wear of the cylinder. Closing the control valve of the secondary injected gas can effectively avoid the condition that liquid is carried in the secondary injected gas and will be benefit of the long-term operation of the compressor, but the performance of the two-stage compression system will be greatly reduced.

Thus, the control valve of the secondary injected gas needs to be always open and also needs to be closed in time in the case that liquid is carried in the secondary injected gas. The performance and reliability of the two-stage compression system will be affected by the accuracy of the judgment to whether or not liquid is carried in the secondary injected gas. At present, the method of detecting superheat degree of the secondary injected gas is commonly used to determine whether or not liquid is carried in the secondary injected gas. This method can only determine whether or not liquid is carried in the secondary injected gas. This method has the following deficiencies: Firstly, in the case that a temperature-sensing package for secondary injected gas is disposed after the gas secondary injection valve, the detection temperature of the secondary injected gas will be decreased due to a certain throttling action of the gas secondary injection valve, which will result in that the gas secondary injection valve is often closed because the superheat degree of the secondary injected gas is detected to be critically low; and secondly, in the case that the temperature-sensing package for secondary injected gas is disposed before the gas secondary injection valve, the detected temperature of the secondary injected gas is higher and the superheat degree of the secondary injected gas is larger, which will result in a situation that a small amount of liquid being carried in the secondary injected gas cannot be detected, thus the reliability of the compressor cannot be ensured.

SUMMARY

Thus, the technical problem of this disclosure is intended to overcome the defect that a compression system in the related art cannot accurately determine whether or not liquid is carried in the secondary injected gas, thereby an air conditioning system, a compression system with gas secondary injection, and judgment and control method thereof is provided.

This disclosure provides a compression system with gas secondary injection, comprising a compressor, an gas secondary injection pipeline and an gas secondary injection valve disposed on the gas secondary injection pipeline, characterized in that, a first pressure detecting device and a first temperature detecting device are disposed at an inlet port of the gas secondary injection valve, and a second temperature detecting device is disposed at an outlet port of the gas secondary injection valve, the inlet port and the outlet port of the gas secondary injection valve are determined based on flowing direction of refrigerant in the gas secondary injection pipeline, the compression system further comprising a second pressure detecting device and a third temperature detecting device disposed on an air discharge pipeline of the compressor.

Optionally, the first temperature detecting device is a first temperature-sensing package for secondary injected gas, the second temperature detecting device is a second temperature-sensing package for secondary injected gas, and the third temperature detecting device is a temperature-sensing package for discharged air.

Optionally, the first pressure detecting device is a medium pressure sensor, and the second pressure detecting device is a high pressure sensor.

Optionally, the gas secondary injection valve is a two-way valve.

Optionally, the gas secondary injection valve is an electromagnetic expansion valve.

Optionally, one end of the gas secondary injection pipeline is connected to a medium pressure suction port of the compressor.

Optionally, the compression system further comprises a flash-tank, and the other end of the gas secondary injection pipeline is connected to the flash-tank.

Optionally, the compressor is a two-stage compressor.

This disclosure further provides an air conditioning system comprising the compression system with gas secondary injection.

This disclosure further provides a judgment and control method for a compression system with gas secondary injection, and an gas secondary injection control is performed for the compression system with gas secondary injection.

Optionally, it is determined whether or not liquid is carried in the secondary injected air based on a superheat degree of the secondary injected air, a temperature difference of the secondary injected air before and after the air secondary injection valve and a superheat degree of the discharged air, wherein the superheat degree of the secondary injected air is detected and calculated by the first pressure detecting device and the first temperature detecting device, the temperature difference is detected and calculated by the first temperature detecting device and the second temperature detecting device, and the superheat degree of the discharged air is detected and calculated by the second pressure detecting device and the third temperature detecting device.

Optionally, the superheat degree of the secondary injected gas (SH1), the superheat degree of the discharged air (SH2) and the temperature difference of the secondary injected gas before and after the gas secondary injection valve (TH) are respectively calculated as below: $SH1=Tm1-Tmc$; $SH2=Td-Tdc$; $TH=Tm1-Tm2$; wherein Tm1, Tm2 and Td represent temperature values detected by the first temperature detecting device, the second temperature detecting device and the third temperature detecting device respectively, Tmc represents a saturated steam temperature corresponding to a pressure value (Pm) detected by the first pressure detecting device, and Tdc represents a saturated steam temperature corresponding to a pressure value (Pd) detected by the second pressure detecting device.

Optionally, the values of SH1, SH2, and TH are detected and calculated at a time interval of T1 minutes during the running of the compressor, in case of $SH2 \geq a$, SH1 and TH are further judged:

in the case that $SH1>b$ and $TH<c$, it is determined that liquid is not carried in the secondary injected gas of the compressor;

in the case that $SH1 \leq b$ or $TH \geq c$, it is determined that a small amount of liquid is carried in the secondary injected gas of the compressor without influence on the reliability of the compressor;

wherein, a represents a predetermined superheat degree for the discharged air, b represents a predetermined superheat degree for the secondary injected gas, c represents a predetermined temperature difference of the secondary injected gas before and after the gas secondary injection valve, T1 represents a predetermined time interval, and a, b, c and T1 are all predetermined constants.

Optionally, the values of SH1, SH2, and TH are detected and calculated at a time interval of T1 minutes during the running of the compressor, in case of $SH2<a$, SH1 and TH are further judged:

in the case that $SH1>b$ and $TH<c$, it is determined that liquid is not carried in the secondary injected gas of the compressor and liquid is carried in suctioned air of the compressor;

in the case that $SH1 \leq b$ or $TH<c$, it is determined that a small amount of liquid is carried in the secondary injected gas without influence on the reliability of the compressor;

in the case that $SH1 \leq b$ and $TH \geq c$, it is determined that a large amount of liquid is carried in the secondary injected gas;

wherein, a represents a predetermined superheat degree for the discharged air, b represents a predetermined superheat degree for the secondary injected gas, c represents a predetermined temperature difference of the secondary injected gas before and after the gas secondary injection valve, T1 represents a predetermined time interval, and a, b, c and T1 are all predetermined constants.

Optionally, the value of the superheat degree for the secondary injected gas (b) is 0, and the value of temperature difference (c) is 1.

Optionally, the gas secondary injection valve is further accurately controlled based on the determination result on whether or not liquid is carried in the secondary injected gas.

Optionally, in the case that the gas secondary injection valve is a two-way valve, the two-way valve will be closed immediately based on considerations of reliability when it is determined that a small amount of liquid is carried in the secondary injected gas.

Optionally, in the case that the gas secondary injection valve is an electronic expansion valve, an opening degree of the electronic expansion valve will be reduced when it is determined that a small amount of liquid is carried in the secondary injected gas; and the electronic expansion valve will be closed immediately when it is determined that a large amount of liquid is carried in the secondary injected gas.

An air conditioning system, a compression system with gas secondary injection, and judgment and control method thereof provided by this disclosure have one or more of the following advantageous effects:

1. A compression system with gas secondary injection according to this disclosure can accurately determine whether or not liquid is carried in the secondary injected gas.
2. Whether a small amount of liquid or a large amount of liquid is carried in the secondary injected gas can be distinguished, so dilution of the lubricant in the compressor, wear of the compressor and even occurrence of liquid impact due to the liquid carried in the secondary injected gas are effectively avoided and service life of a two-stage compressor can be prolonged.
3. In this disclosure, the injecting volume of gas and the state of the secondary injected gas can be accurately controlled by injecting secondary gas with an electronic expansion valve, thus the system operation efficiency is improved and the long-term reliability of a two-stage compressor is ensured.
4. The system and method are simple and reliable, and cost thereof is low.

In the figures, denotation of reference signs is as the following:

1—compressor, 2—gas secondary injection pipeline, 3—gas secondary injection valve, 4—first pressure detecting device, 5—first temperature detecting device, 6—second temperature detecting device, 7—second pressure detecting device, 8—third temperature detecting device, 9—flash-tank, 11—air discharge pipeline, 12—medium pressure suction port.

DETAILED DESCRIPTION

Figure 1:
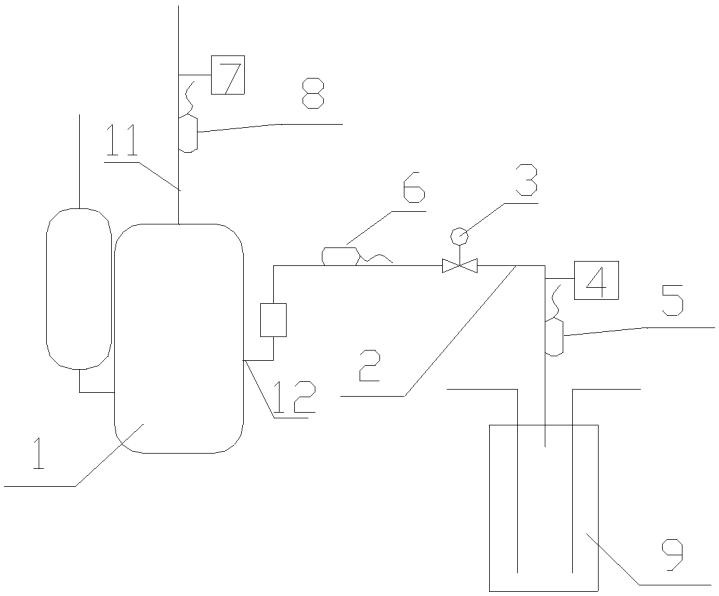
FIG. 1 is a schematic structural view of a compression system with gas secondary injection according to this disclosure.

As shown in FIG. 1, this disclosure provides a compression system with gas secondary injection, comprising a compressor 1, an gas secondary injection pipeline 2 and an gas secondary injection valve 3 disposed on the gas secondary injection pipeline 2, wherein a first pressure detecting device 4 and a first temperature detecting device 5 are disposed at an inlet port of the gas secondary injection valve 3, and a second temperature detecting device 6 is disposed at an outlet port of the gas secondary injection valve 3, the inlet port and the outlet port of the gas secondary injection valve 3 are determined based on flowing direction of refrigerant in the gas secondary injection pipeline, the compression system further comprising a second pressure detecting device 7 and a third temperature detecting device 8 disposed on an air discharge pipeline 11 of the compressor.

By means of a compression system with gas secondary injection according to the disclosure, it is determined effectively whether or not liquid is carried in the secondary injected gas based on a superheat degree of the secondary injected gas, a temperature difference of the secondary injected gas before and after the gas secondary injection valve and a superheat degree of the discharged air, wherein the superheat degree of the secondary injected gas, the temperature difference of the secondary injected gas before and after the gas secondary injection valve and the superheat degree of the discharged air are detected and calculated by a first, second, third temperature detecting device, and a first, second pressure detecting device; and further, by means of this system, whether a small amount of liquid or a large amount of liquid is carried in the secondary injected gas can be distinguished, thereby the gas volume secondary injected by a two-stage compressor can be effectively controlled, so as to prevent occurrence of liquid impact in the compressor, and to ensure reliable and high efficient operation of the two-stage compressor in a long term. The method is simple and reliable, and cost thereof is low.

Optionally, the first temperature detecting device 5 is a first temperature-sensing package for secondary injected gas, the second temperature detecting device 6 is a second temperature-sensing package for secondary injected gas, and the third temperature detecting device 8 is a temperature-sensing package for discharged air. The first temperature detecting device which is optionally selected as the first temperature-sensing package for secondary injected gas, can accurately detect a temperature at a front end of the gas secondary injection valve (according to flowing direction of refrigerant) in the gas secondary injection pipeline, thereby providing an effective precondition for calculation of the superheat degree of the secondary injected gas at this place; the second temperature detecting device which is optionally selected as the second temperature-sensing package for secondary injected gas can accurately detect a temperature at a rear end of the gas secondary injection valve (according to flowing direction of refrigerant) in the gas secondary injection pipeline, so as to provide an effective precondition for calculation of the temperature difference of the secondary injected gas before and after the gas secondary injection valve; the third temperature detecting device which is optionally selected as the temperature-sensing package for discharged air can accurately detect temperature of the discharged air in the air discharge pipeline 11 of the compressor, so as to provide an effective precondition for calculation of the superheat degree of the discharged air at this place.

Optionally, the first pressure detecting device 4 is a medium pressure sensor, and the second pressure detecting device 7 is a high pressure sensor. The first pressure detecting device which is optionally selected as the medium pressure sensor can accurately detect a pressure (medium pressure) at the front end of the gas secondary injection valve (according to flowing direction of refrigerant) in the gas secondary injection pipeline, so as to calculate a saturated steam temperature corresponding to this pressure value, thereby providing an effective precondition for calculation of the superheat degree of the secondary injected gas at this place; the second pressure detecting device which is optionally selected as the high pressure sensor can accurately detect a pressure (high pressure) of the air discharge pipeline 11 of the compressor, so as to calculate a saturated steam temperature corresponding to this pressure value, thereby providing an effective precondition for calculation of the superheat degree of the discharged air at this place.

The gas secondary injection valve 3 is optionally selected as a two-way valve. The two-way valve can perform a control operation by means of opening or closing effectively according to whether or not liquid is carried in the secondary injected gas, so as to prevent occurrence of liquid impact in the compressor and improve the reliability of the operation.

The gas secondary injection valve 3 is optionally selected as an electromagnetic expansion valve. The electromagnetic expansion valve can be opened or closed effectively according to whether or not liquid is carried in the secondary injected gas, and can be closed or reduced the opening degree according as a small or large amount of liquid is carried in the secondary injected gas, so as to prevent occurrence of liquid impact in the compressor and improve the reliability of the operation.

Optionally, one end of the gas secondary injection pipeline 2 is connected to a medium pressure suction port 12 of the compressor 1. The refrigerant in the gas secondary injection pipeline can be effectively filled into the medium pressure suction port of the compressor through the connection mode of the gas secondary injection pipeline 2, so as to play an effective role in enthalpy-increase by gas secondary injection.

Optionally, the compression system further comprises a flash-tank 9, and the other end of the gas secondary injection pipeline 2 is connected to the flash-tank 9. By providing the flash-tank, it is capable of effectively performing the flash evaporation to the liquid and gaseous refrigerants, such that the gaseous and liquid refrigerants are effectively separated. The gaseous refrigerant enters the medium pressure suction port of the compressor through the gas secondary injection pipeline, so as to play an effective role in enthalpy-increase by gas secondary injection.

Optionally, the compressor 1 is a two-stage compressor. The compressor of this disclosure is intended to perform two-stage pressurization, so as to reduce a compression ratio of a single compressor, and inject gas supplementally between the stages, so as to increase the enthalpy value of the refrigerant operating. Of course, the compressor 1 is not limited to a two-stage compressor, but may also be a multi-stage type, or a structure in which two or more compressors are connected in series.

This disclosure further provides an air conditioning system comprising the compression system with gas secondary injection. By means of the air conditioning system, it is determined effectively whether or not liquid is carried in the secondary injected gas based on a superheat degree of the secondary injected gas, a temperature difference of the secondary injected gas before and after the gas secondary injection valve and a superheat degree of the discharged air. The superheat degree of the secondary injected gas, the temperature difference of the secondary injected gas before and after the gas secondary injection valve, and the superheat degree of the discharged air are detected and calculated by a first, second, third temperature detecting device and a first, second pressure detecting device. Further, by means of the air conditioning system, whether a small amount of liquid or a large amount of liquid is carried in the secondary injected gas can be distinguished, thereby the gas volume secondary injected by a two-stage compressor can be effectively controlled, so as to prevent occurrence of liquid impact in the compressor and to ensure reliable and high efficient operation of the two-stage compressor in a long term. The method is simple and reliable, and cost thereof is low.

Figure 2:
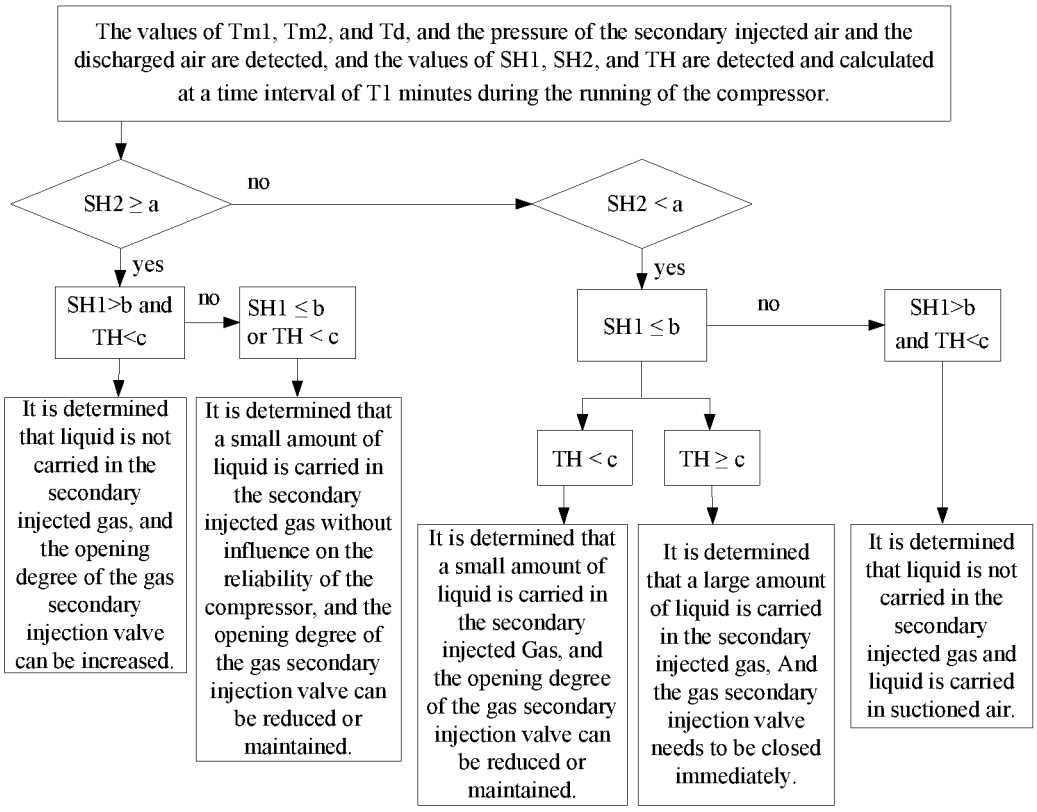
FIG. 2 is a schematic diagram of the judgment and control flow of a judgment and control method for a compression system with gas secondary injection according to this disclosure.

As shown in FIG. 2, this disclosure further provides a judgment and control method for a compression system with gas secondary injection, and an gas secondary injection control is performed for the compression system with gas secondary injection. By performing judgment and control for the secondary injected gas of the compression system with gas secondary injection, it is determined effectively whether or not liquid is carried in the secondary injected gas based on a superheat degree of the secondary injected gas, a temperature difference of the secondary injected gas before and after the gas secondary injection valve and a superheat degree of the discharged air. The superheat degree of the secondary injected gas, the temperature difference of the secondary injected gas before and after the gas secondary injection valve and the superheat degree of the discharged air are detected and calculated by a first, second, third temperature detecting device, and a first, second pressure detecting device. Further, by means of the air conditioning system, whether a small amount of liquid or a large amount of liquid is carried in the secondary injected gas can be distinguished, thereby the gas volume secondary injected by a two-stage compressor can be effectively controlled, so as to prevent occurrence of liquid impact in the compressor and to ensure reliable and high efficient operation of the two-stage compressor in a long term. The method is simple and reliable, and cost thereof is low.

Optionally, it is determined whether or not liquid is carried in the secondary injected gas based on a superheat degree of the secondary injected gas, a temperature difference of the secondary injected gas before and after the gas secondary injection valve and a superheat degree of the discharged air. The superheat degree of the secondary injected gas is detected and calculated by the first pressure detecting device and the first temperature detecting device, the temperature difference is detected and calculated by the first temperature detecting device and the second temperature detecting device, and the superheat degree of the discharged air is detected and calculated by the second pressure detecting device and the third temperature detecting device. This is the specific judging method. This method is capable of determining whether or not liquid is carried in the secondary injected gas, distinguishing whether a small amount of liquid or a large amount of liquid is carried in the secondary injected gas, so as to ensure reliable and high efficient operation of the compressor in a long term.

Optionally, the superheat degree of the secondary injected gas (SH1), the superheat degree of the discharged air (SH2) and the temperature difference of the secondary injected gas before and after the gas secondary injection valve (TH) are respectively calculated as below: $SH1=Tm1-Tmc$; $SH2=Td-Tdc$; $TH=Tm1-Tm2$. Tm1, Tm2 and Td represent temperature values detected by the first temperature detecting device, the second temperature detecting device and the third temperature detecting device respectively. Tmc represents a saturated steam temperature corresponding to a pressure value (Pm) detected by the first pressure detecting device. Tdc represents a saturated steam temperature corresponding to a pressure value (Pd) detected by the second pressure detecting device. This is the specific steps of detecting and calculating the superheat degree of the secondary injected gas (SH1), the superheat degree of the discharged air (SH2) and the temperature difference of the secondary injected gas before and after the gas secondary injection valve (TH) during the process of the judgment method.

Optionally, the values of Tm1, Tm2, and Td, and the pressure of the secondary injected gas and the discharged air are detected, and the values of SH1, SH2, and TH are detected and calculated at a time interval of T1 (T1 can be preset as needed) minutes during the running of the compressor. As shown in FIG. 2, the specific judgment method is as the following:

in case of $SH2 \geq a$ (indicating a high superheat degree of the discharged air), SH1 and TH are further judged:

in the case that $SH1>b$ and $TH<c$, it is determined that liquid is not carried in the secondary injected gas of the compressor, representing a high superheat degree of refrigerant at the front end of the gas secondary injection valve, and a small temperature drop through the two ends of the gas secondary injection valve, indicating that liquid is not carried in the secondary injected gas entering the compressor;

in the case that $SH1 \leq b$ or $TH \geq c$, it is determined that a small amount of liquid is carried in the secondary injected gas of the compressor without influence on the reliability of the compressor, representing a low superheat degree of refrigerant at the front end of the gas secondary injection valve, and a large temperature drop through the two ends of the gas secondary injection valve, indicating that a small amount of liquid is carried in the secondary injected gas entering the compressor (if a large amount of liquid is carried in the secondary injected gas, the superheat degree of the discharged air, i.e. SH2 should be necessarily low, but as the precondition here is a high superheat degree of the discharged air, so it is usually impossible that a large amount of liquid is carried in the secondary injected gas under this condition).

Wherein, a represents a predetermined superheat degree for the discharged air, b represents a predetermined superheat degree for the secondary injected gas, c represents a predetermined temperature difference of the secondary injected gas before and after the gas secondary injection valve, T1 represents a predetermined time interval, and a, b, c and T1 are all predetermined constants.

By the above means of judgment, it is capable of effectively determining whether or not or how much liquid is carried in the secondary injected gas under the condition of a high superheat degree of the discharged air.

Optionally, in case of SH2<a (indicating a low superheat degree of the discharged air), SH1 and TH are further judged:

in the case that SH1>b and TH<c, it is determined that liquid is not carried in the secondary injected gas of the compressor and liquid is carried in suctioned air of the compressor, representing a high superheat degree of refrigerant at the front end of the gas secondary injection valve, and a small temperature drop through the two ends of the gas secondary injection valve, indicating that liquid is not carried in the secondary injected gas entering the compressor, and indicating that liquid is carried in suctioned air of the compressor due to SH2<a.

in the case that SH1≤b or TH<c, it is determined that a small amount of liquid is carried in the secondary injected gas without influence on the reliability of the compressor, representing a low superheat degree of refrigerant at the front end of the gas secondary injection valve, and a small temperature drop through the two ends of the gas secondary injection valve, indicating that a small amount of liquid is carried in the secondary injected gas entering the compressor without influence on the reliability of the compressor.

in the case that SH1≤b and TH≥c, it is determined that a large amount of liquid is carried in the secondary injected gas (i.e. a large amount of liquid carried in the secondary injected gas can cause a large temperature drop), and the gas secondary injection valve needs to be closed immediately, representing a low superheat degree of refrigerant at the front end of the gas secondary injection valve, and a large temperature drop through the two ends of the gas secondary injection valve, indicating that a large amount of liquid is carried in the secondary injected gas.

wherein, a represents a predetermined superheat degree for the discharged air, b represents a predetermined superheat degree for the secondary injected gas, c represents a predetermined temperature difference of the secondary injected gas before and after the gas secondary injection valve, and a, b and c are all predetermined constants, which are determined according to the system solution.

By the above means of judgment, it is capable of effectively determining whether or not or how much liquid is carried in the suctioned air under the condition of a low superheat degree of the discharged air.

Optionally, the value of the superheat degree for the secondary injected gas (b) is 0, and the value of temperature difference of the secondary injected gas before and after the gas secondary injection valve (c) is 1. These are optional values for the b and c, which values are obtained based on a large number of experiments and research processes. Further, c may be optionally selected to be 1, 1.5 or 2 according to specific condition of the system.

Optionally, the gas secondary injection valve is further accurately controlled based on the determination result on whether or not liquid is carried in the secondary injected gas. Based on the judgment result, the gas secondary injection valve is controlled to further effectively control the liquid carried in the secondary injected gas of the compressor, so as to prevent liquid from entering the compressor and producing a liquid impact, thereby ensuring reliable operation.

Optionally, in the case that the gas secondary injection valve is a two-way valve, the two-way valve will be closed immediately based on reliability consideration (i.e., considering in view of reliability) when it is determined that a small amount of liquid is carried in the secondary injected gas. This is a specific control method of the gas secondary injection valve as a preferred embodiment of a two-way valve, which can effectively prevent the liquid from entering the compressor.

Optionally, in the case that the gas secondary injection valve is an electronic expansion valve, an opening degree of the electronic expansion valve will be reduced when it is determined that a small amount of liquid is carried in the secondary injected gas, so as to protect the compressor from liquid impacts while maintaining highly efficient operation of the system. The electronic expansion valve will be closed immediately when it is determined that there is a sudden change to the state of the system, i.e. it is changed from the state of no liquid carried into the state of a large amount of liquid carried in the secondary injected gas, so as to protect the long-term reliable operation of the compressor. The compressor will be protected from liquid impacts while maintaining highly efficient and long-term reliable operation of the system.

Preferred embodiments of this disclosure are described as below.

As shown in FIG. 1, this disclosure is determined whether or not liquid is carried in the secondary injected gas based on a superheat degree of the secondary injected gas, a temperature difference of the secondary injected gas before and after the gas secondary injection valve and a superheat degree of the discharged air. This method is capable of determining whether or not liquid is carried in the secondary injected gas, distinguishing the state that a small amount of liquid or a large amount of liquid is carried in the secondary injected gas, and ensuring reliable and high efficient operation of the compressor in a long term.

As shown in FIG. 2, the specific solution is as the following:

The temperature 1 of the secondary injected gas, the temperature 2 of the secondary injected gas, and the temperature of the discharged air detected by the first temperature detecting device 5, the second temperature detecting device 6, and the third temperature detecting device 8 of the compressor are defined as Tm1, Tm2, and Td respectively. Locations of each of the temperature-sensing packages and each of pressure sensors are shown in FIG. 1. The medium pressure detected by the medium pressure sensor at the temperature-sensing package for secondary injected gas is defined as Pm, and the corresponding saturated steam temperature is defined as Tmc; the pressure of the discharged air detected by the high pressure sensor at the temperature-sensing package for discharged air is defined as Pd, and the corresponding saturated steam temperature is defined as Tdc. The superheat degree of the secondary injected gas and the superheat degree of the discharged air are defined respectively as SH1 and SH2, and the temperature difference of the secondary injected gas before and after the gas secondary injection valve is defined as TH, such that:

$$SH1=Tm1-Tmc;$$

$$SH2=Td-Tdc;$$

$$TH=Tm1-Tm2.$$

According to this solution, on the basis of the superheat degree of the secondary injected gas, the temperature-sensing package for secondary injected gas and the medium pressure sensor are mounted between the gas secondary injection valve and the flash-tank, and as shown in FIG. 1, the second temperature detecting device 6 and the superheat degree of the discharged air are provided additionally as the basis of judgment, such that it can accurately determine whether or not liquid is carried in the secondary injected gas. The values of Tm1, Tm2, and Td, and the pressure of the secondary injected gas and the discharged air are detected, and the values of SH1, SH2, and TH are detected and calculated, at a time interval of T1 minutes during the running of the compressor. As shown in FIG. 2, the specific judgment method is as the following:

in case of SH2≥a, SH1 and TH have the following conditions:

in the case that SH1>0 and TH<1, it is determined that liquid is not carried in the secondary injected gas of the compressor;

in the case that SH1≤0 or TH≥1, it is determined that a small amount of liquid is carried in the secondary injected gas of the compressor without influence on the reliability of the compressor;

in case of SH2<a, SH1 and TH have the following conditions:

in the case that SH1>0 and TH<1, it is determined that liquid is not carried in the secondary injected gas of the compressor and liquid is carried in suctioned air of the compressor;

in the case that SH1≤0 or TH<1, it is determined that a small amount of liquid is carried in the secondary injected gas without influence on the reliability of the compressor;

in the case that SH1≤0 and TH≥1, it is determined that a large amount of liquid is carried in the secondary injected gas, and the gas secondary injection valve needs to be closed immediately;

Wherein a, b, c are all constants, and actual values of which are determined according to the system solution.

The gas secondary injection valve is further accurately controlled based on the determination result on whether or not liquid is carried in the secondary injected gas. In the case that the gas secondary injection valve is a two-way valve, the two-way valve will be closed immediately based on reliability consideration when it is determined that a small amount of liquid is carried in the secondary injected gas. In the case that the gas secondary injection valve is an electronic expansion valve, an opening degree of the electronic expansion valve will be reduced when it is determined that a small amount of liquid is carried in the secondary injected gas, so as to protect the compressor from liquid impacts while maintaining highly efficient operation of the system. The electronic expansion valve will be closed immediately when it is determined that there is a sudden change to the state of the system, i.e. it is changed from the state of no liquid carried into the state of a large amount of liquid carried in the secondary injected gas, so as to protect the long-term reliable operation of the compressor.

Those skilled in the art can easily understand that the above advantageous manners can be freely combined and superposed in condition of no conflict.

The above-mentioned is only preferred embodiments of this disclosure, but such embodiments are not intended to limit this disclosure. Any modification, equivalent replacement, improvement and so on made within the spirit and principle of this disclosure, should be included in the protection scope of this disclosure. The above description is only preferred embodiments of this disclosure, and it should be pointed out that those skilled in the art can make various modifications and variations without departing from the technical principle of this disclosure. Such modifications and variations should also be regarded as falling within the protection scope of this disclosure.

What is claimed is:

1. A compression system with gas secondary injection, comprising a compressor, a gas secondary injection pipeline and a gas secondary injection valve disposed on the gas secondary injection pipeline, wherein, a first pressure detecting device and a first temperature detecting device are disposed at an inlet port of the gas secondary injection valve, and a second temperature detecting device is disposed at an outlet port of the gas secondary injection valve, the inlet port and the outlet port of the gas secondary injection valve are determined based on flowing direction of refrigerant in the gas secondary injection pipeline, the compression system further comprising a second pressure detecting device and a third temperature detecting device disposed on an air discharge pipeline of the compressor, wherein whether or not liquid is carried in the secondary injected gas is determined based on a superheat degree of the secondary injected gas, a temperature difference of the secondary injected gas before and after the gas secondary injection valve and a superheat degree of the discharged air; and wherein the superheat degree of the secondary injected gas is detected and calculated by the first pressure detecting device and the first temperature detecting device, the temperature difference is detected and calculated by the first temperature detecting device and the second temperature detecting device, and the superheat degree of the discharged air is detected and calculated by the second pressure detecting device and the third temperature detecting device.

2. The compression system with gas secondary injection according to claim 1, wherein the first temperature detecting device is a first temperature-sensing package for secondary injected gas, the second temperature detecting device is a second temperature-sensing package for secondary injected gas, and the third temperature detecting device is a temperature-sensing package for discharged air.

3. The compression system with gas secondary injection according to claim 1, wherein the first pressure detecting device is a medium pressure sensor, and the second pressure detecting device is a high pressure sensor.

4. The compression system with gas secondary injection according to claim 1, wherein the gas secondary injection valve is a two-way valve.

5. The compression system with gas secondary injection according to claim 1, wherein the gas secondary injection valve is an electromagnetic expansion valve.

6. The compression system with gas secondary injection according to claim 1, wherein one end of the gas secondary injection pipeline is connected to a medium pressure suction port of the compressor.

7. The compression system with gas secondary injection according to claim 6, wherein the compression system further comprises a flash-tank, and the other end of the gas secondary injection pipeline is connected to the flash-tank.

8. The compression system with gas secondary injection according to claim 1, wherein the compressor is a two-stage compressor.

9. An air conditioning system comprising a compression system with gas secondary injection according to claim 1.

10. A judgment and control method for a compression system with gas secondary injection, wherein an gas secondary injection control is performed for the compression system with gas secondary injection according to claim 1.

11. The judgment and control method according to claim 10, wherein the superheat degree of the secondary injected gas (SH1), the superheat degree of the discharged air (SH2)

and the temperature difference of the secondary injected gas before and after the gas secondary injection valve (TH) are respectively calculated as below:

$$SH1=Tm1-Tmc;$$

$$SH2=Td-Tdc;$$

$$TH=Tm1-Tm2;$$

wherein, Tm1, Tm2 and Td represent temperature values detected by the first temperature detecting device, the second temperature detecting device and the third temperature detecting device respectively, Tmc represents a saturated steam temperature corresponding to a pressure value (Pm) detected by the first pressure detecting device, and Tdc represents a saturated steam temperature corresponding to a pressure value (Pd) detected by the second pressure detecting device.

12. The judgment and control method according to claim 11, wherein:

the values of SH1, SH2, and TH are detected and calculated at a time interval of T1 minutes during the running of the compressor, in case of SH2≥a, SH1 and TH are further judged:

in the case that SH1>b and TH<c, it is determined that liquid is not carried in the secondary injected gas of the compressor;

in the case that SH1≤b or TH≥c, it is determined that a small amount of liquid is carried in the secondary injected gas of the compressor without influence on the reliability of the compressor;

in the case of SH2<a, SH1 and TH are further judged:

in the case that SH1>b and TH<c, it is determined that liquid is not carried in the secondary injected gas of the compressor and liquid is carried in suctioned air of the compressor;

in the case that SH1≤b or TH<c, it is determined that a small amount of liquid is carried in the secondary injected gas without influence on the reliability of the compressor;

in the case that SH1≤b and TH≥c, it is determined that a large amount of liquid is carried in the secondary injected gas;

wherein, a represents a predetermined superheat degree for the discharged air, b represents a predetermined superheat degree for the secondary injected gas, c represents a predetermined temperature difference of the secondary injected gas before and after the gas secondary injection valve, T1 represents a predetermined time interval, and a, b, c and T1 are all predetermined constants.

13. The judgment and control method according to claim 12, wherein: the gas secondary injection valve is further accurately controlled based on the determination result on whether or not liquid is carried in the secondary injected gas.

14. The judgment and control method according to claim 13, wherein: in the case that the gas secondary injection valve is a two-way valve, the two-way valve will be closed immediately based on considerations of reliability when it is determined that a small amount of liquid is carried in the secondary injected gas.

15. The judgment and control method according to claim 13, wherein: in the case that the gas secondary injection valve is an electronic expansion valve, an opening degree of the electronic expansion valve will be reduced when it is determined that a small amount of liquid is carried in the secondary injected gas; and the electronic expansion valve will be closed immediately when it is determined that a large amount of liquid is carried in the secondary injected gas.

* * * * *